US006030163A

United States Patent [19]

Flannery, Jr.

[11] Patent Number: 6,030,163

[45] **Date of Patent: *Feb. 29, 2000**

[54] METHOD FOR PRODUCING BOUND VOLUMES

[75] Inventor: James W. Flannery, Jr., Stamford, Conn.

[73] Assignee: Heidelberger Druckmaschinen Ag, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/717,509

[22] Filed: Sep. 20, 1996

[51] Int. Cl.[7] ..... B42C 9/00

[52] U.S. Cl. ..... 412/8; 281/151; 281/21.1; 281/29; 412/1; 412/9; 412/19; 412/901; 412/902

[58] Field of Search ..... 412/1–9, 19–21, 412/25, 33, 17, 18, 34, 37, 900, 901, 902; 281/15.1, 21.1, 22, 29, 36, 37

[56] References Cited

U.S. PATENT DOCUMENTS

| | | | |
|---|---|---|---|
| 335,683 | 2/1886 | Chapman . | |
| 467,851 | 1/1892 | Bowman . | |
| 928,518 | 7/1909 | Howell . | |
| 934,311 | 9/1909 | Hoberg . | |
| 1,011,651 | 12/1911 | Stavens . | |
| 1,852,963 | 4/1932 | Fladmark . | |
| 2,193,545 | 3/1940 | Ainsworth . | |
| 3,956,053 | 5/1976 | Staats . | |
| 4,073,510 | 2/1978 | Scharlin | 281/15.1 |
| 4,143,889 | 3/1979 | Scharlin | 281/15.1 |
| 4,149,288 | 4/1979 | Sendor et al. . | |
| 4,184,218 | 1/1980 | Hawkes | 281/21.1 X |
| 4,420,282 | 12/1983 | Axelrod | 412/4 |
| 4,729,175 | 3/1988 | Beard et al. . | |
| 4,828,636 | 5/1989 | Rausing | 412/8 X |
| 4,877,269 | 10/1989 | Callaghan et al. | 281/38 |
| 4,960,295 | 10/1990 | Bodouroglou | 281/15.1 |
| 4,975,011 | 12/1990 | Holmberg | 412/6 |
| 5,078,424 | 1/1992 | Kadish | 281/21.1 |
| 5,213,369 | 5/1993 | Evans | 281/21.1 |
| 5,350,268 | 9/1994 | Muller | 412/1 |
| 5,443,674 | 8/1995 | Fresonke et al. | 412/8 |
| 5,456,496 | 10/1995 | Kadish | 281/21.1 |
| 5,499,847 | 3/1996 | Smith | 281/29 |

FOREIGN PATENT DOCUMENTS

WO 85/04669 10/1985 WIPO .

*Primary Examiner*—Andrea L. Pitts
*Assistant Examiner*—Monica Smith
*Attorney, Agent, or Firm*—Fish & Neave; Jeffrey H. Ingerman; N. Govindaswamy

[57] ABSTRACT

A method of fusing two or more pieces along an edge to produce a bound volume uses an activating agent which dissolves and mixes with a component present on the pieces, and thereby causes the edges of the various pieces to fuse together. The method is particularly useful for producing bound periodicals and magazines.

24 Claims, 6 Drawing Sheets

METHOD FOR PRODUCING BOUND VOLUMES

BACKGROUND OF THE INVENTION

This invention relates to a method of fusing two or more pieces along an edge to produce a volume. More particularly, this invention relates to a method of fusing two or more pieces along an edge by adding an activating agent which dissolves and mixes with a component on the pieces, and thereby causes the edges of the various pieces to fuse together. The method of this invention is particularly useful for producing bound periodicals and magazines.

A magazine or a periodical typically comprises a stack of individual sheets or folios bound together. If individual two-sided sheets are bound together, then each individual sheet represents two pages in a bound magazine or periodical. If a stack of two-sided double spread sheets, termed folios, are bound together, then each folio represents four pages in the bound magazine or periodical.

A common method for producing magazines or periodicals involves collating a stack of sheets or folios and holding the stack together with a staple, commonly referred to in the art as a pin. The use of a pin limits the thickness of a periodical or a magazine. Typically, a stack of folios is collated to produce a signature, and pinned together. A typical pinned magazine comprises a single signature pinned along the center folio. The center folio, which is also referred to as the center spread, represents the midpoint of such a magazine. The center spread is unique in that it has the maximum continuous printable area in the typical magazine. The availability of more than one center spread in a magazine would significantly enhance the value of a magazine. But in the typical pinned magazine comprising a single signature as described above, there is only one center spread available. Furthermore, in the single center spread of such a magazine, the pins are visible along the center. The pins can obscure the printed matter or distract the reader.

Another common method for producing magazines or periodicals involves the use of a hot-melt adhesive. Typically, a hot polyurethane adhesive is used in this method. To bind a stack of individual sheets, a hot polyurethane adhesive is applied to an edge of the stack, and the bound edge is allowed to cool and dry. The time required for cooling and drying the bound edge is often long. As a result, the rate at which the bound magazines or periodicals are produced may be relatively slow. Secondly, the adhesive adds to the thickness of the bound edge. This can be a detrimental feature in commercial magazines and periodicals wherein the standards of aesthetics and form are extremely competitive and high.

Hot-melt adhesives are also used to bind a stack of signatures, wherein each signature comprises two or more folios. In a typical method for binding a stack of signatures using an adhesive, the edge of the stack that is to be bound is cut to expose the edge of each individual sheet to the adhesive. As a result, the advantage of having a center spread in each signature is lost because the resulting volume comprises individual sheets bound at an edge with no center spread. Alternatively, the folios of each signature are bound together in known ways as the signature is assembled, and then the signatures are bound together by the hot-melt adhesive. While this technique may preserve the various center spreads, it still has the drawbacks associated with the use of hot-melt adhesives.

It would be desirable to be able to produce a magazine or a periodical having more than one center spread.

It would also be desirable to produce a magazine or a periodical wherein the center spread has no visible pins, thereby enhancing the effect of the printed matter.

It would further be desirable to fuse a stack of sheets along an edge with a minimal waiting time for cooling and drying the bound edge.

It would still further be desirable to minimize the thickness of the bound edge in the resulting magazine or periodical.

It would yet further be desirable to fuse a stack of signatures along an edge without cutting the signatures, and thereby retain the center spreads in each signature.

SUMMARY OF THE INVENTION

It is an object of this invention to produce a magazine or a periodical having more than one center spread.

It is also an object of this invention to produce a magazine or a periodical wherein the center spread has no visible pins, thereby enhancing the effect of the printed matter.

It is a further object of this invention to fuse a stack of sheets along an edge with a minimal waiting time for cooling and drying the bound edge.

It is a still further object of this invention to minimize the thickness of the bound edge in the resulting magazine or periodical.

It is yet a further object of this invention to fuse a stack of signatures along an edge without cutting the signatures, and thereby retain the center spreads in each signature.

In accordance with the present invention, there is provided a method for fusing two or more pieces into a volume having a bound edge and an open edge opposite the bound edge. The method involves collating two or more pieces into a stack having a front piece and a rear piece, and adding an activating agent along an edge of the stack. The pieces have a surface component that is soluble in the activating agent, thus causing the pieces to fuse. The volume thus bound is then dried using known drying methods.

BRIEF DESCRIPTION OF THE DRAWINGS

The above and other objects and advantages of the invention will be apparent upon consideration of the following detailed description, taken in conjunction with the accompanying drawings, and in which like reference characters refer to like parts throughout, and in which.

DETAILED DESCRIPTION OF THE INVENTION

Figure 1:
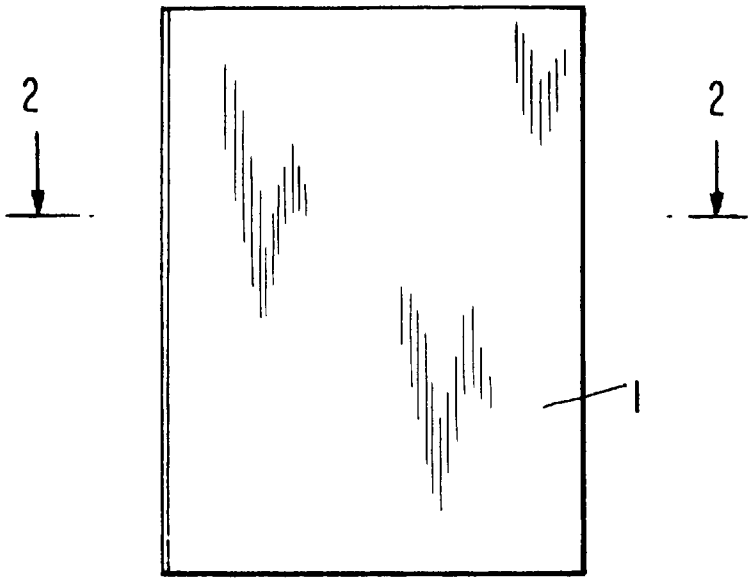
FIG. 1 is a front view of pieces collated into a stack with a square-back alignment.

The present invention provides a method for fusing two or more pieces into a volume. Two or more pieces are collated and fused along an edge by applying an activating agent that dissolves and mixes with a component present in the pieces. This causes the edges of the pieces to fuse together. Subsequent drying of the fused edge produces a bound volume.

A piece, as defined herein, is a single sheet of paper or a signature, which is one or more folios bound or fused at an edge. The pieces used in this invention include a component that may be dissolved by an activating agent. For example, the paper used in magazines typically contains lignin fibers bound together by a latex polymer. In such a paper, the latex polymer constitutes the component that dissolves in and mixes with the activating agent.

An activating agent, as defined herein, is a single compound or a mixture of compounds preferably dissolved in a solvent. The activating agent is preferably capable of dissolving and mixing with a component present in or on the pieces. The preferred activating agents for the present invention require a relatively short time to dry. A particularly useful activating agent, when the soluble component in the pieces is a latex, is a butyl-ethylene copolymer.

A stack, as defined herein, is a stack of pieces having a front piece and a rear piece, and produced by sequentially placing pieces one on top of another.

A square-back alignment, as defined herein, is an alignment of the stack wherein the pieces are exactly aligned one on top of another such that the back edge of the stack is substantially perpendicular to both the front piece and the rear piece.

A front-skew alignment, as defined herein, is an alignment wherein the pieces of the stack are aligned in a first direction parallel to the edge to be bound, and each piece, progressing from the rear piece to the front piece, is displaced by an increasing amount in a direction perpendicular to the edge to be bound toward the edge which, after binding, will be the open edge.

A rear-skew alignment, as defined herein, is an alignment wherein the pieces of the stack are aligned in a first direction parallel to the edge to be bound, and each piece, progressing from the front piece to the rear piece, is displaced by an increasing amount in a direction perpendicular to the edge to be bound toward the edge, which after binding, will be the open edge.

A front-skew angle, as defined herein, is the angle formed by the bound edge of the stack and the rear piece in a front-skew alignment.

A rear-skew angle, as defined herein, is the angle formed by the bound edge of the stack and the front piece of a rear-skew alignment.

A tapered alignment, as defined herein, is an alignment wherein three or more pieces are aligned in a first direction parallel to the edge to be bound. Each of the pieces, progressing from an intermediate piece to the front piece, is displaced by an increasing amount in a second direction perpendicular to the edge to be bound and toward the opposite edge, which, after binding, will be the open edge. Each of the pieces, progressing from the intermediate piece to the rear piece, is similarly displaced by an increasing amount in the second direction perpendicular to the edge to be bound and toward the opposite edge, which, after binding, will be the open edge.

According to the method of the present invention, two or more pieces are collated to form a stack of a desired alignment. An activating agent is then applied to an edge of the stack. The activating agent dissolves and mixes with a component present in the pieces and, as a result, fuses the edges of the stack. The fused edge is then dried to produce a bound volume.

The method of the present invention is particularly useful for producing bound periodicals and magazines. The pieces used in periodicals and magazines typically contain lignin fibers derived from wood pulp, held together by a latex polymer. The present invention takes advantage of the solubility of components such as latex polymers in suitable activating agents. Upon adding a suitable activating agent to an edge of a stack comprising pieces of a magazine, the latex polymer present in the pieces dissolves in and mixes with the activating agent and causes the pieces to fuse. Thus, the present invention includes active participation of a component present in the pieces with the activating agent. As a result of this active participation, the amount of activating agent required to bind the pieces is less than conventional adhesives. Moreover, after the pieces have fused together most of the activating agent preferably can be driven off, as by drying. Therefore, an increase in the thickness of the bound edge would likely be minimal.

A preferred activating agent for producing bound magazines and periodicals according to the present invention comprises a butyl-ethylene copolymer dissolved in an appropriate solvent. The copolymer activating agent dissolves and mixes with the latex polymer present in the pieces of a magazine. The mixing can be described at a molecular level as an entanglement or intertwining of the latex polymer chains with each other and with the polymer chains present in the copolymer activating agent. This intertwining fuses the edge of each piece with the edge of at least each adjacent piece. The solvent and any unreacted copolymer can then be driven off, preferably by drying.

In a typical magazine or a periodical, the sheets are given a glossy appearance by adding a thin layer of clay to the surface of the paper. In such magazine pieces possessing a surface layer of clay, the activating agent preferably penetrates through the clay layer and mixes with the latex polymer present in the pieces, thereby causing the edges of the various pieces to fuse. The penetration of the activating agent through the clay layer can be optimized by altering, for example, the viscosity of the solvent used in the activating agent or the temperature of the activating agent.

The step of drying the fused edge according to the present invention can be accomplished by conventional drying methods. The shorter drying times required for the activating agents of the present invention reduces the time required for producing each bound volume. This reduction in time is particularly advantageous in automated processes for producing magazines. A preferred drying method involves drying the fused edge ultrasonically.

The step of collating the pieces can be performed using conventional collating methods. Typically, the step of collating pieces for producing bound periodicals and magazines is performed in one or more hoppers. A preferred method of collating two or more pieces according to the present invention involves an automated collating process performed in a series of hoppers.

The pieces used in the method of the present invention can be single sheets of paper, or signatures comprising one or more folios.

The method of the present invention is particularly useful in producing magazines or periodicals comprising two or more signatures fused along an edge. Because each signature contains a center spread, a magazine produced by fusing two or more signatures according to the present invention will contain as many center spreads as the number of signatures used in the magazine. The increased number of center spreads available significantly enhances the value of a magazine produced according to the present invention, as center spreads are more valuable, e.g., to advertisers.

The present invention can be practiced using various constructions of the pieces depending on the type of bound volume desired.

In one construction according to the present invention two or more pieces are collated to produce a stack with a square-back alignment, having a front piece and a rear piece. This construction is illustrated in FIGS. 1 and 2.

Figure 2:
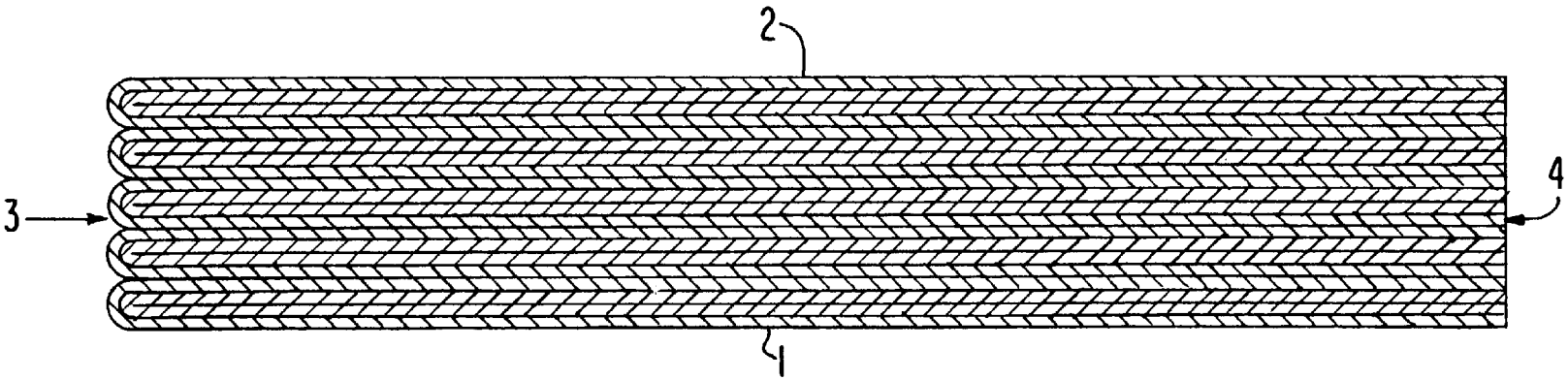
FIG. 2 is a cross-sectional view of the pieces collated into a stack with a square-back alignment.

FIG. 1 depicts the front view of a series of sections of a periodical or a magazine collated to form a stack having a square-back alignment, with front piece 1 and a rear piece 2. Edge 3 of the stack is to be bound, while edge 4 is to be the open end of the resulting volume. FIG. 2 shows a cross-sectional view of the pieces collated according to FIG. 1. The activating agent is applied along edge 3. The activating agent causes the pieces to fuse along edge 3. Subsequent drying produces the desired bound periodical or magazine with a square-back. A cover piece may then be attached using any conventional technique.

Alternatively, in another construction according to the present invention, two or more pieces are collated to produce a stack having a front piece and a rear piece. The activating agent is then applied to an edge of the stack. A cover piece also capable of fusing is then wrapped around the stack to produce a fused square-back volume having a cover piece. Preferably, the cover piece wraps around the front piece and the rear piece. This construction is further illustrated in FIGS. 7 and 8.

Figure 7:
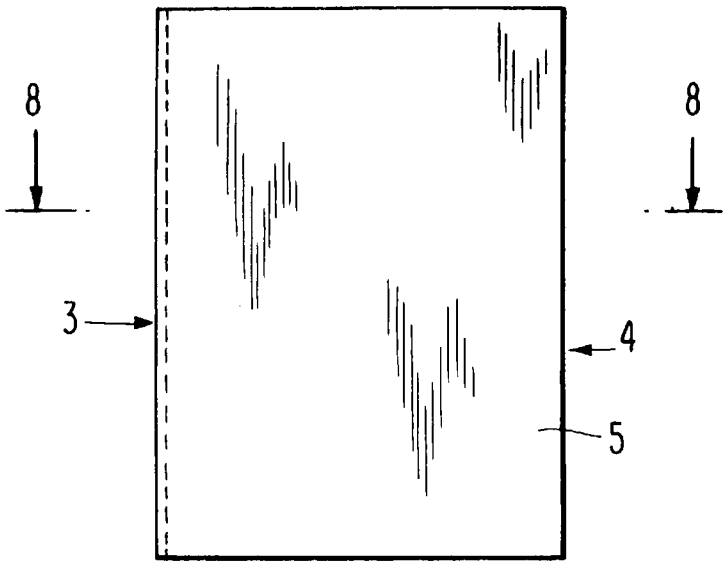
FIG. 7 is a front view of pieces collated into a stack with a square-back and a cover piece.
Figure 8:
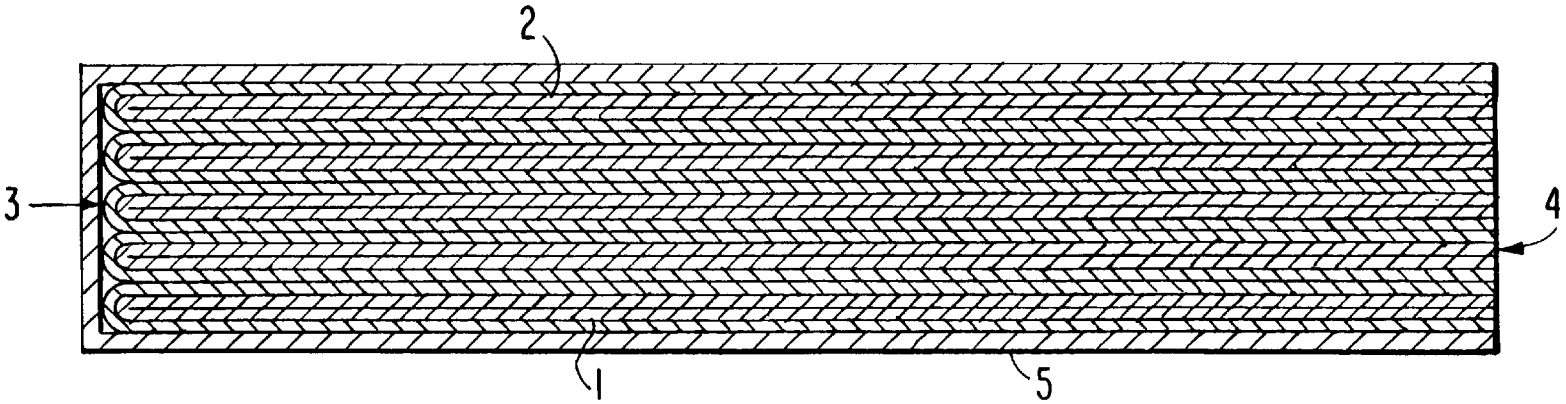
FIG. 8 is a cross-sectional view of the pieces collated into a stack with a square-back and a cover piece.

FIG. 7 depicts the front view of a series of pieces of a periodical or a magazine collated to form a stack having a square-back alignment, and having a cover piece 5 that wraps around front piece 1 and rear piece 2. Edge 3 in FIG. 7 is to be bound, while edge 4 is to be open in the resulting volume. FIG. 8 shows a cross-sectional view of the pieces collated according to FIG. 7. The activating agent is applied to edge 3 between the cover piece 5 and the stack, causing the edges of the pieces and the cover piece 5 to fuse. Subsequent drying produces the desired bound periodical or magazine.

In another construction according to the present invention, two or more pieces are collated to produce a stack with a front skew, having a front piece and a rear piece. The pieces are first aligned in a first direction parallel to the edge to be bound. Each of the pieces, progressing from the rear piece to the front piece, is displaced by an increasing amount in a second direction perpendicular to the edge to be bound and toward the opposite edge, which, after binding, will be the open edge. This construction is illustrated in FIGS. 3 and 4.

Figure 3:
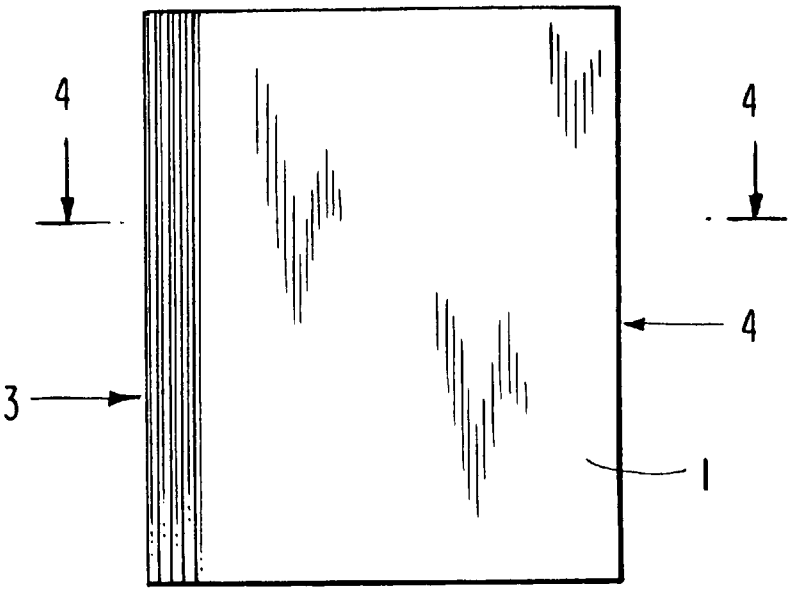
FIG. 3 is a front view of pieces collated into a stack with a front-skew.
Figure 4:
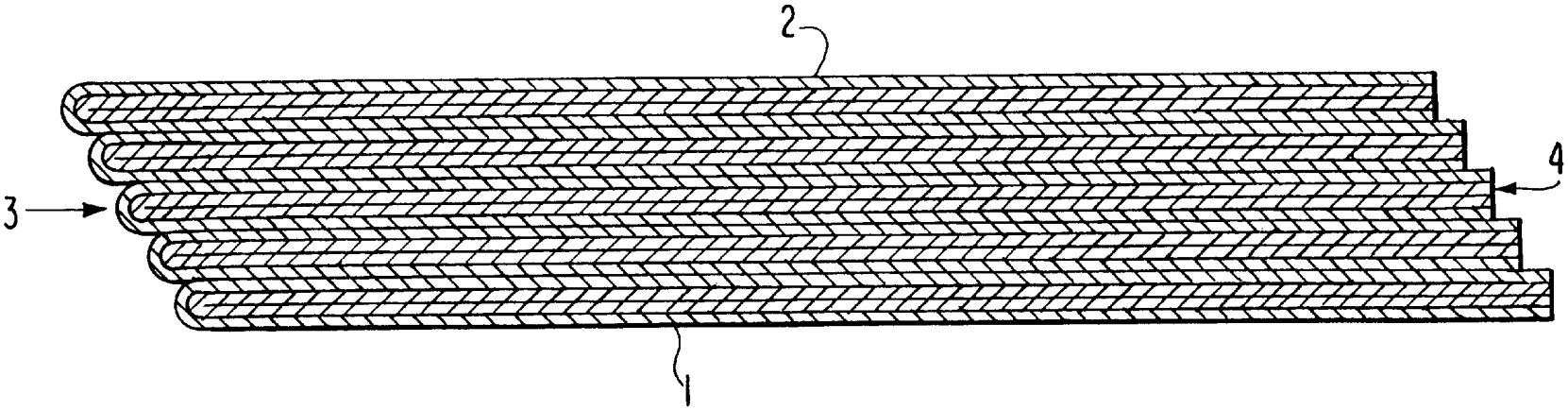
FIG. 4 is a cross-sectional view of the pieces collated into a stack with a front-skew.

FIG. 3 depicts the front view of a series of pieces of a periodical or a magazine collated to form a stack having a front-skew alignment, with a front piece 1 and a rear piece 2. Edge 3 of FIG. 3 is to be bound, while edge 4 is to be the open end of the resulting volume. FIG. 4 shows a cross-sectional view of the pieces collated according to FIG. 3. The activating agent is applied along edge 3. The activating agent causes the pieces to fuse along edge 3. Subsequent drying produces the desired periodical or magazine with a front skew.

The front-skew angle between the bound edge of the stack and the rear piece preferably ranges from about 15° to about 60°. In FIG. 4, the front-skew angle is defined by edge 3 and rear piece 2. More preferably, the front-skew angles ranges from about 30° to about 60°. The most preferred front-skew angle is about 40°.

In a variation of front-skew construction described above, a cover piece is added to the stack after applying the activating agent. Preferably, the cover piece wraps around and binds to the front piece and the rear piece. Alternatively, a cover piece may be added in any other suitable manner.

In another construction according to the present invention, two or more pieces are collated to produce a stack with a rear-skew alignment, having a front piece and a rear piece. The pieces are aligned in a first direction parallel to the edge to be bound. Each of the pieces, progressing from the front piece to rear piece, is displaced by an increasing amount in a second direction perpendicular to the edge to be bound and toward the opposite edge which, after binding, will be the open edge. This construction is illustrated in FIGS. 5 and 6.

Figure 5:
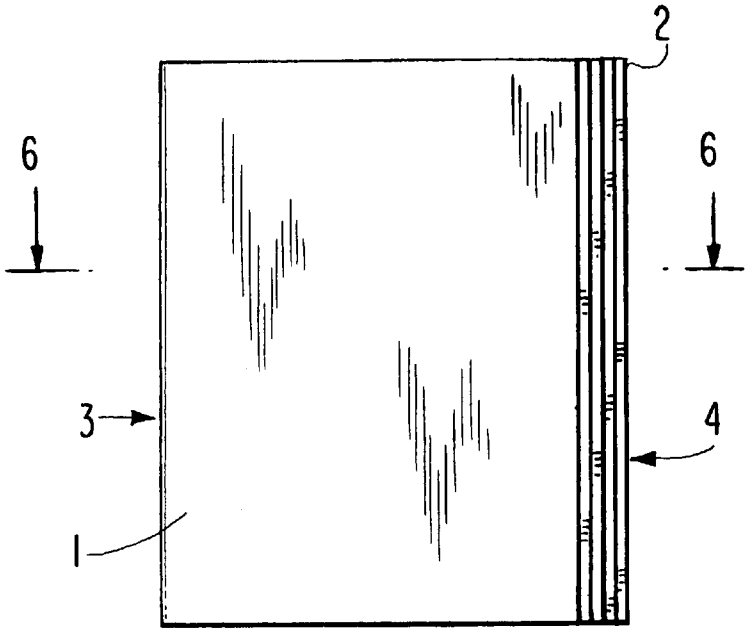
FIG. 5 is a front view of pieces collated into a stack with a rear-skew.
Figure 6:
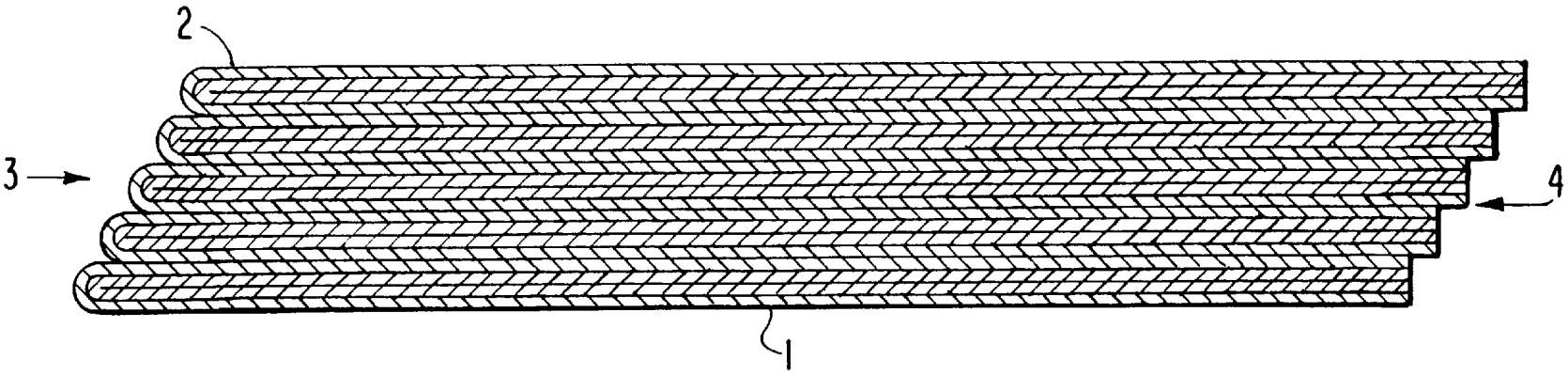
FIG. 6 is a cross-sectional view of the pieces collated into a stack with a rear-skew.

FIG. 5 depicts the front view of a series of sections of a periodical or a magazine collated to form a stack having a rear-skew alignment, with a front piece 1 and a rear piece 2. Edge 3 of FIG. 5 is to be bound, while edge 4 is to be the open end of the resulting volume. FIG. 6 shows a cross-sectional view of the pieces collated according to FIG. 5. The activating agent is applied along edge 3. The activating agent causes the sections to fuse along edge 3. Subsequent drying produces the desired periodical or magazine with a rear-skew.

The rear-skew angle between the bound edge of the stack and the front piece preferably ranges from about 15° to about 60°. In FIG. 6, the rear-skew angle is defined by bound edge 3 and front piece 1. More preferably, the rear-skew angle ranges from about 30° to about 60°. The most preferred rear-skew angle is about 40°.

In a variation of the rear-skew construction described above, a cover piece also capable of fusing may be added to the stack after applying the activating agent. Preferably, the cover piece wraps around and fuses to the front piece and the rear piece. Alternatively, a cover piece may be attached in any other suitable manner.

In another construction according to the present invention, a stack of pieces with a front piece and a rear piece, and having a tapered alignment is used to produce a bound volume. Three or more pieces are aligned in a first direction parallel to the edge to be bound. Each of the pieces, progressing from the front piece to an intermediate piece which may or may not be the middle piece, is displaced by an increasing amount in a second direction perpendicular to the edge to be bound and toward the opposite edge, which, after binding, will be the open edge. Each of the pieces, progressing from the intermediate piece to the rear piece, is also displaced by an increasing amount in the second direction perpendicular to the edge to be bound and toward the opposite edge, which, after binding, will be the open edge. This construction is illustrated in FIGS. 11 and 12.

Figure 11:
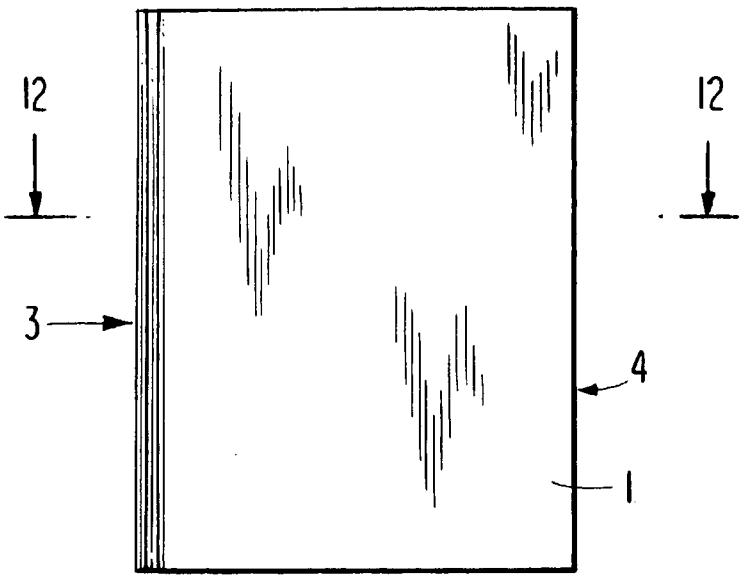
FIG. 11 is a front view of the pieces collated into a stack with a tapered alignment.
Figure 12:
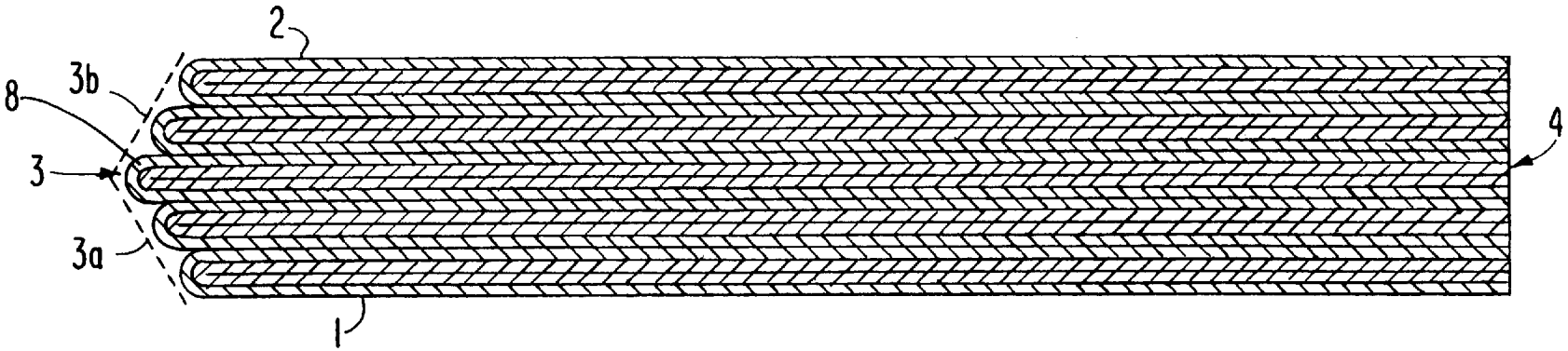
FIG. 12 is a cross-sectional view of the pieces collated into a stack with a tapered alignment.

FIG. 11 depicts the front view of a series of sections of a periodical or a magazine collated to form a stack having a tapered alignment, with a front piece 1, a rear piece 2 and an intermediate piece 8, which in the embodiment shown is the center piece. Edge 3 of FIG. 11 is to be bound, while edge 4 is to be the open end of the resulting volume. FIG. 12 shows a cross-sectional view of the sections collated according to FIG. 11. The activating agent is applied along edge 3. The activating agent causes the sections to fuse along edge 3. Subsequent drying produces the desired periodical or magazine with a tapered alignment.

A front angle defined by the intermediate piece 8 and the front segment 3*a* of the edge of the stack, and a second angle defined by the intermediate piece 8 and the rear segment 3*b* of the edge of the stack, independently range from about 15° to about 80°. In FIG. 12, the first angle 10 is defined by edge segment 3*a* and intermediate piece 8, while the second angle 11 is defined by edge segment 3*b* and intermediate piece 8. More preferably, the first and second angles 10 and 11 independently range from about 30° to about 50°. Most preferably, each of the first and second angles 10 and 11 are independently about 40°.

In any of the skewed or tapered constructions shown herein, depending on the displacement of the pieces to be bound, the skew or taper may result in a corresponding complementary skew or taper at the open end, which is preferably trimmed so that the open edge is substantially square.

In another construction according to the present invention, two or more pieces are collated to produce a stack with a square-back alignment, having a front piece and a rear piece. A linear tube with a triangular cross-section is then placed along the to-be bound edge of the stack. The activating agent is applied to the three sides of the linear tube. A cover piece is then placed over the stack such that the linear tube is held between the cover piece and the edge to be bound. This construction is further illustrated in FIG. 9 and FIG. 10.

Figure 9:
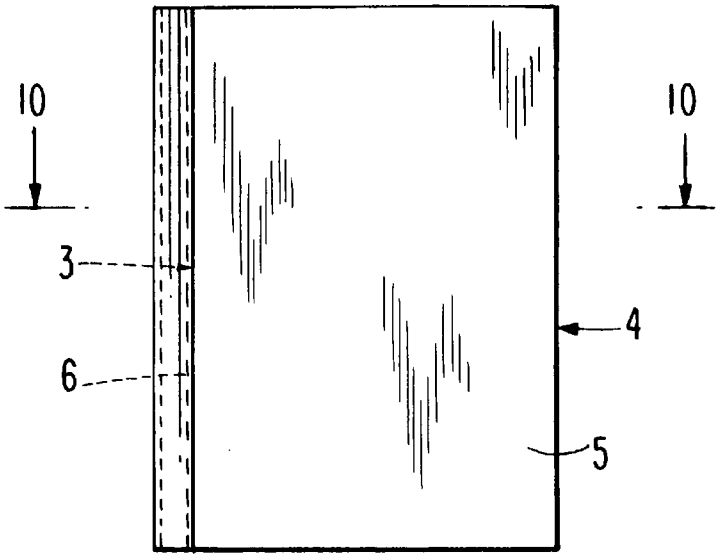
FIG. 9 is a front view of the pieces collated into a stack, with a linear tube having a triangular cross-section placed between the pieces and the cover piece.
Figure 10:
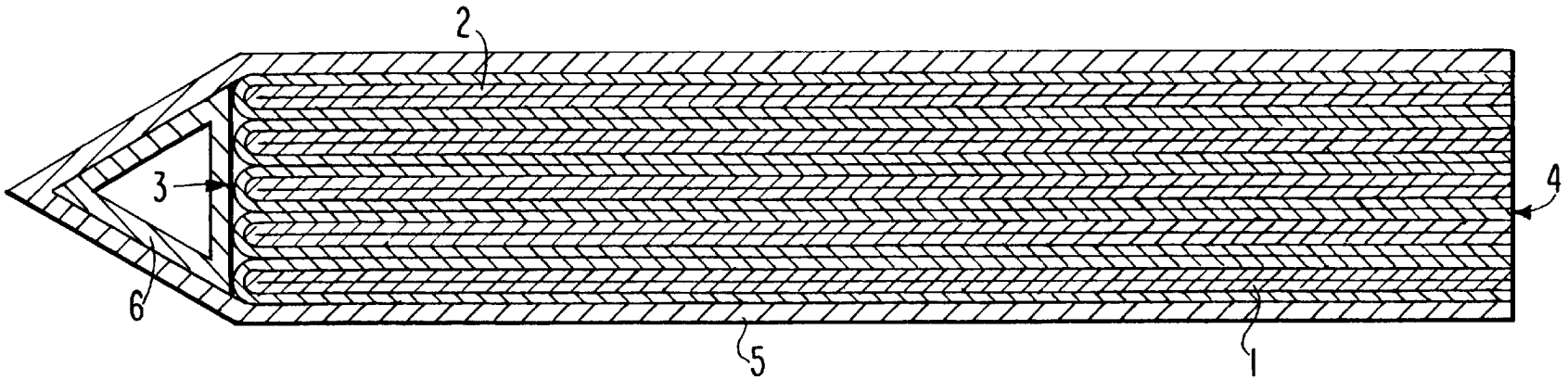
FIG. 10 is a cross-sectional view of the pieces collated into a stack, with a linear tube having a triangular cross-section placed between the pieces and the cover piece.

FIG. 9 shows a front view of a series of pieces collated into a stack with front piece 1 and rear piece 2, and having a linear tube 6 with a triangular cross-section placed between edge 3 of the stack and the cover piece 5. FIG. 10 shows the cross-sectional view of the sections collated according to FIG. 9. The pieces 1, 2 and cover piece 5 fuse together, preferably holding tube 6 in place. Depending on the material of tube 6, tube 6 itself may also fuse to pieces 1,2, and cover piece 5. The fused edge is then dried to produce a volume having a tapered appearance.

Thus, it will be seen that a method of fusing two or more pieces, into a volume having a bound edge and a bound edge has been provided. The pieces contain a component that is soluble in an activating agent. The method is particularly suited for producing magazines and periodicals having more than one center spread. One skilled in the art will appreciate that the present invention can be practiced by other than the described embodiments, which are presented for purposes of illustration and not of limitation, and the present invention is limited only by the claims which follow.

What is claimed is:

1. A method for fusing pieces into a volume, said volume having a bound edge and an open edge opposite said bound edge, said method comprising:

collating at least two pieces into a stack having a front piece and a rear piece, wherein, alone said bound edge, each of said at least two pieces comprises a component that is substantially present throughout a cross-section of said each of said at least two pieces, wherein said cross-section is perpendicular to a to-be-bound surface of said each of said at least two pieces, and wherein said component is soluble in an activating agent; and adding said activating agent to dissolve at least a portion of said component and cause said at least two pieces to fuse along said bound edge.

2. The method according to claim 1, further comprising adding a cover piece to said stack after adding said activating agent.

3. The method according to claim 2, wherein said cover piece wraps around said front piece and said rear piece.

4. The method according to claim 1, wherein said component is a latex polymer.

5. The method according to claim 4, wherein said activating agent comprises a butyl ethylene copolymer.

6. The method according to claim 1, wherein said at least two pieces of said stack are aligned in a first direction parallel to said bound edge, each of said at least two pieces progressing from a first of said front piece and said rear piece to a second of said front piece and said rear piece, and are displaced by an increasing amount in a direction perpendicular to said bound edge toward said open edge.

7. The method according to claim 6, wherein said each of said at least two pieces, progressing from said front piece to said rear piece, is displaced by an increasing amount in a direction perpendicular to said bound edge toward said open edge such that said bound edge and said front piece define an angle ranging from about 15° to about 60°.

8. The method according to claim 7, wherein said angle ranges from about 30° to about 50°.

9. The method according claim 8, wherein said angle is about 40°.

10. The method according to claim 6, wherein each of said pieces, progressing from said rear piece to said front piece, is displaced by an increasing amount in a direction perpendicular to said bound edge toward said open edge such that said bound edge and said rear piece define an angle ranging from about 15° to about 60°.

11. The method according to claim 10, wherein said angle ranges from about 30° to about 50°.

12. The method according to claim 11, wherein said angle is about 40 °.

13. The method according to claim 1, wherein:

said stack comprises an intermediate piece;

said at least two pieces of said stack are aligned in a first direction parallel to said bound edge;

each of said at least two pieces, progressing from said intermediate piece to said front piece, is displaced by an increasing amount in a direction perpendicular to said bound edge toward said open edge such that said bound edge and said front piece define a first angle ranging from about 15° to about 80°; and each of said at least two pieces, progressing from said intermediate piece to said rear piece, is displaced by an increasing amount in a direction perpendicular to said bound edge toward said open edge such that said bound edge and said rear piece define a second angle ranging from about 15° to about 80°.

14. The method according to claim 13, wherein each of said first angle and said second angle ranges from about 30° to about 50°.

15. The method according to claim 14, wherein each of said first angle and said second angle is about 40°.

16. The method according to claim 1, further comprising ultrasonically drying said bound edge.

17. The method according to claim 1, wherein each of said at least two pieces comprises at least one sheet.

18. The method according to claim 17, wherein at least one of said at least two pieces comprises a single sheet.

19. The method according to claim 17, wherein at least one of said at least two pieces comprises a signature.

20. A volume having a bound edge and an open edge opposite said bound edge, said volume comprising at least two pieces, wherein, alone said bound edge, each of said at least two pieces comprises a component that is substantially present throughout a cross-section of said each of said at least two pieces, said cross-section being perpendicular to a to-be-bound surface of said each of said at least two pieces, and that is soluble in an activating agent, and wherein said at least two pieces are fused together by said component to which said activating agent has been applied.

21. A method for fusing pieces into a volume, said volume having a bound edge and an open edge opposite said bound edge, said method comprising:

collating at least two pieces into a stack having a front piece and a rear piece, wherein, along said bound edge, each of said at least two pieces is substantially formed from fibers and a component that binds said fibers together, and wherein said component is soluble in an activating agent; and adding said activating agent to dissolve at least a portion of said component and cause said at least two pieces to fuse along said bound edge.

22. A method for fusing pieces into a volume, said volume having a bound edge and an open edge opposite said bound edge, said method comprising:

collating at least two pieces into a stack having a front piece and a rear piece, wherein, along said bound edge, each of said at least two pieces comprises a component that is present within an interior region of said each of said at least two pieces, and wherein said component is soluble in an activating agent; and adding said activating agent to dissolve at least a portion of said component and cause said at least two pieces to fuse to another piece along said bound edge.

23. A volume having a bound edge and an open edge opposite said bound edge, said volume comprising at least two pieces, wherein, along said bound edge, each of said at least two pieces is substantially formed from fibers and a component that binds said fibers together, wherein said component is soluble in an activating agent, and wherein said at least two pieces are fused together by said component to which said activating agent has been applied.

24. A volume having a bound edge and an open edge opposite said bound edge, said volume comprising at least two pieces, wherein, along said bound edge, each of said at least two pieces comprises a component that is present within an interior region of said each of said at least two pieces, wherein said component is soluble in an activating agent, and wherein said at least two pieces are fused together by said component to which said activating agent has been applied.

* * * * *